United States Patent [19]

Balz

[11] 4,177,608

[45] Dec. 11, 1979

[54] FINISHING APPARATUS EMBODYING IMPROVED SEAL AND METHOD

[75] Inventor: Gunther W. Balz, Kalamazoo, Mich.

[73] Assignee: Roto-Finish Company, Inc., Kalamazoo, Mich.

[21] Appl. No.: 869,469

[22] Filed: Jan. 16, 1978

[51] Int. Cl.[2] ..... B24B 31/00

[52] U.S. Cl. ..... 51/163.2; 51/313; 277/96.1

[58] Field of Search ..... 51/163.2, 163.1, 313; 277/96.1, 22, 156; 241/175

[56] References Cited

U.S. PATENT DOCUMENTS

| | | | |
|---|---|---|---|
| 2,846,245 | 8/1958 | Weaver | 277/22 |
| 3,435,565 | 4/1969 | Blundell | 51/313 |
| 3,744,805 | 7/1973 | Henrich | 277/96.1 |
| 3,957,276 | 5/1976 | Weise | 277/22 |
| 3,990,188 | 11/1976 | Balz | 51/163.2 |

FOREIGN PATENT DOCUMENTS

| | | | |
|---|---|---|---|
| 36157 | of 1971 | Japan | 51/133.2 |
| 357087 | 9/1931 | United Kingdom | 277/22 |

*Primary Examiner*—Harold D. Whitehead
*Attorney, Agent, or Firm*—Gordon W. Hueschen

[57] ABSTRACT

Apparatus and method for surface finishing of parts or workpieces by attrition, in the presence of a liquid vehicle, with loose, comminuted, granular, or particulate solid finishing material or media, comprising relatively large finishing particles, i.e., chips, is described. The apparatus comprises a finishing chamber having a containing surface comprising an upstanding wall and a bottom symmetrically arranged about a common axis, being relatively rotatable about said axis, and having apposed closely-spaced surfaces, with a resilient seal having correspondingly apposed elements therebetween, the apposed elements of said seal being in closely-spaced apart or touching relationship and the surface of at least one of said apposed seal elements being irregular. The bottom, e.g., is adapted to rotate about the common axis and thus to impart motion to the contents of the chamber and impell them radially outwardly by centrifugal force, thereby also building up a liquid pressure head along the outer edge areas of the finishing chamber bottom. The spacing and irregularities in the apposed seal elements provide communication between the chamber and the exterior, and said spacing and irregularities are of a size sufficient to permit outflow of liquid vehicle under the said head of liquid pressure, including fine abrasive, metal, or like material ("fines") which may be entrained therein, but insufficient to permit passage of workpieces and finishing chips.

26 Claims, 10 Drawing Figures

Fig. 3.
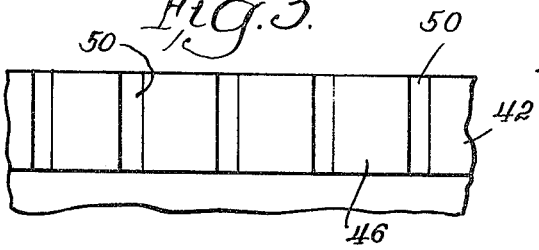
Fig. 4.
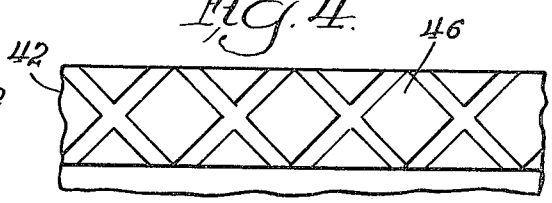
Fig. 5.
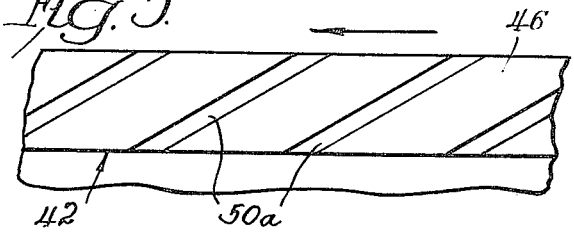
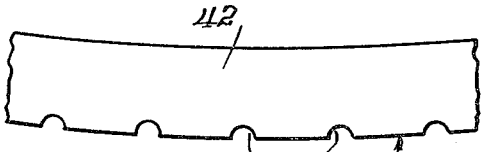
Fig. 6
Fig. 7.
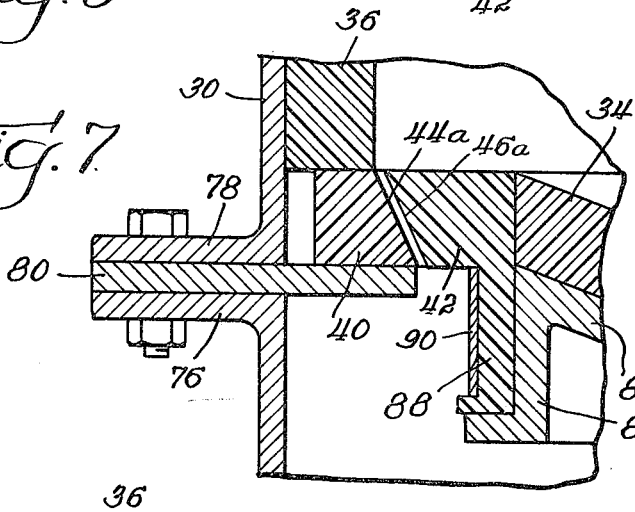
Fig. 8.
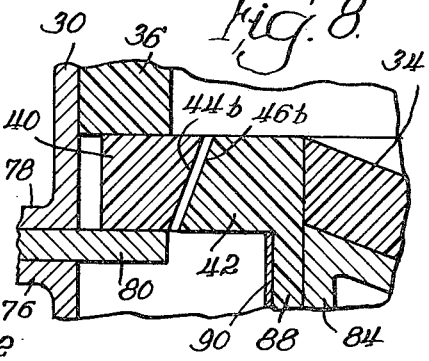
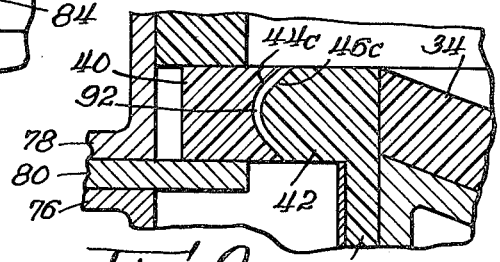
Fig. 9.
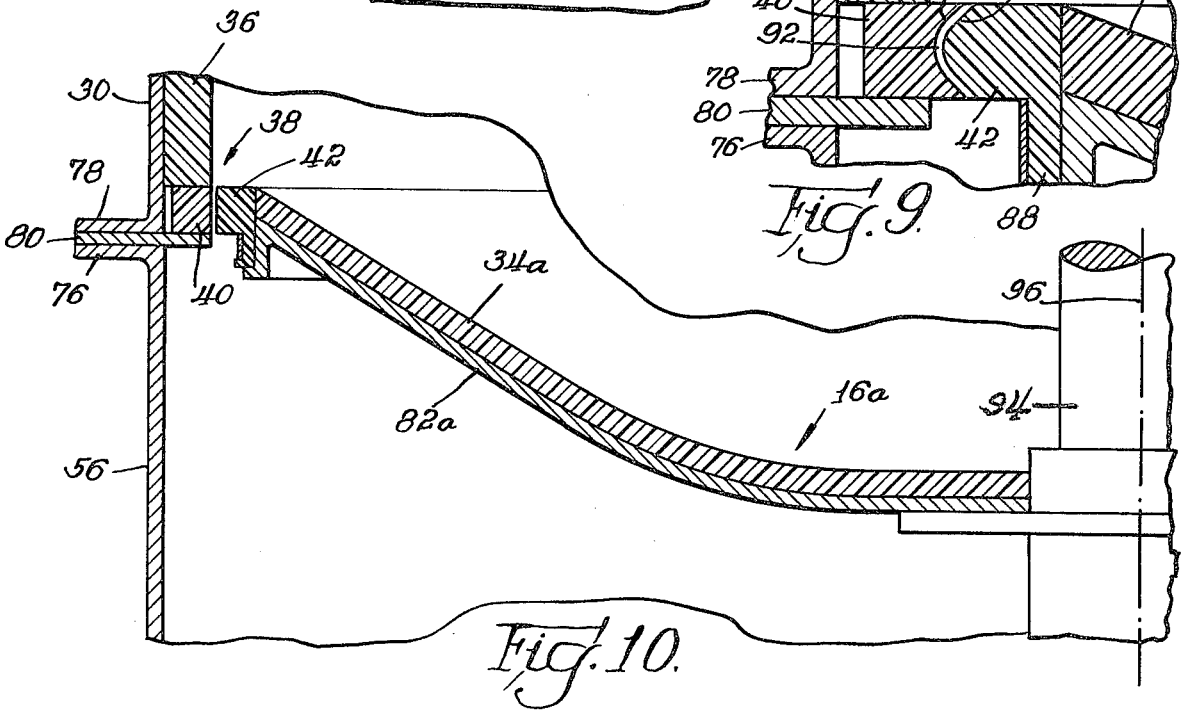
Fig. 10.

FINISHING APPARATUS EMBODYING IMPROVED SEAL AND METHOD

FIELD OF INVENTION

Prior Art

This invention relates to apparatus and method for the surface finishing of parts or workpieces by attrition with finishing material comprising relatively large finishing particles, i.e., chips, in a finishing chamber in the presence of a liquid vehicle. In its broader aspects, it relates to such apparatus and method in which the finishing chamber includes a containing surface comprising a bottom and an upstanding wall which are symetrically arranged about a common axis and which are relatively rotatable about said axis in order to impart motion to the contents of the finishing chamber. It is particularly directed to such apparatus and method in which the bottom of the finishing chamber rotates relative to an outer upstanding wall, which is usually stationary, and through centrifugal action causes the contents to move radially outward toward and to impinge upon said upstanding wall.

Apparatus and method of the claims described are disclosed in U.S. Pat. Nos. 3,435,565, 3,990,188, and 4,026,075, as well as in German Offenlegungsschrift No. 27 05 445. In these patents, a seal is usually provided which prevents outflow of liquid vehicle from the finishing chamber. Such seals generally involve a rubbing contact between flat surfaces of the seal and the rotating bottom, of the seal and the upstanding wall, or of the seal itself. These arrangements are costly, inefficient, require excessive power to overcome the considerable friction between the relatively-moving surfaces, and are conducive to excessive wear, which necessitates frequent replacement of the sealing means. Since such a seal requires lubrication, the most advanced prior art structures have employed a pump and associated equipment, to force lubricating fluid into the seal from below, as essential ancillary apparatus. The prior art approaches obviously leave much to be desired and completely overlook the simple, direct, and efficient theory, structure, and method of the present invention.

OBJECTS OF THE INVENTION

It is an object of the invention to provide improved apparatus and method of the class described. It is a further object of the invention to provide improved sealing means for use in apparatus and method of the class described. It is a further object of the invention to provide apparatus and method of the class described in which rubbing contact of even or flat surfaces of the seal elements with themselves or with other parts of the apparatus is eliminated. Another object is to provide such apparatus and method wherein the liquid vehicle, as commonly employed in such finishing procedure, is itself employed as lubricant and coolant for the seal, to provide an exit path for unnecessary and undesired "fines" out of the finishing area, and to utilize closely-spaced or touching irregular-surfaced seal elements, together with the centrifugal or outward radial force built up by relative rotation of the containing surface parts, to effect such desirable results simply and efficiently. It is an additional object of the invention to provide apparatus and method of the class described in which the seal elements can be readily replaced. It is a further object of the invention to avoid the disadvantages of prior art apparatus and method and to obtain such advantages, including elimination of unnecessary ancillary lubrication apparatus, as will appear as the description proceeds. Additional objects and advantages will be apparent to one skilled in the art and still others will become apparent hereinafter.

BRIEF DESCRIPTION OF THE INVENTION

The objects of this invention are attained by provision of a method for the surface finishing of parts or workpieces which comprises:

subjecting said parts or workpieces to attrition by realtive motion with loose, comminuted, granular, or particulate solid finishing material comprising relatively large finishing chips in the presence of a liquid vehicle in a finishing chamber, having a containing surface comprising an outer upstanding wall portion and and a bottom portion, with a seal between, characterized by providing said seal with resilient apposed surfaces, having irregularities on at least one surface and spacing of a size sufficient to permit passage therethrough of liquid vehicle under pressure, causing relative motion between said portions of said containing surface and between said workpieces and said finishing chips, causing said vehicle, said workpieces, and said finishing chips to flow over said containing surface and across said seal to cause finishing of said workpieces and to develop a resulting liquid pressure head in the area of said seal, and causing flow of said liquid vehicle to the exterior of said containing surface through said seal under the influence of said liquid pressure head, while preventing flow to the exterior of said workpieces and said finishing chips through said seal, thereby simultaneously lubricating and cooling said seal and removing fines entrained in said liquid vehicle from said finishing chamber.

Preferably, in said method, the bottom is rotatable and the method includes the step of rotating said bottom about said axis, whereby liquid vehicle is impelled radially outwardly by centrifugal force generated by rotation of said bottom, thereby developing said liquid pressure head. Preferably also, the liquid vehicle is caused to flow radially outwardly and to impinge upon said wall. Generally the flow to the exterior of said liquid vehicle is effected adjacent a point at which outwardly-flowing liquid vehicle impinges upon said wall, and advantageously the flow of liquid vehicle to the exterior is directed downwardly.

The objects of the present invention are also attained by provision of an apparatus for finishing workpieces by attrition with finishing media comprising relatively large finishing chips in the presence of a liquid vehicle, which includes:

a finishing chamber having a containing surface comprising an outer upstanding wall and a bottom, said upstanding wall and said bottom being symmetrically arranged about a common axis and being relatively rotatable about said axis in order to impart motion to the contents of said chamber for finishing of said parts, and means for causing such relative motion, characterized in that said wall and said bottom have closely-spaced apposed surfaces and a resilient seal having corresponding apposed elements therebetween, the apposed elements of said seal being in closely-spaced or touching relationship and the surface of at least one of said apposed seal elements being irregular, thereby providing communication between said chamber and the exterior, said spacing and irregularities being of a size sufficient to permit flow from the interior to the exterior of said finishing chamber of liquid vehicle therein, including "fines" which may be entrained therein, when placed under a head of liquid pressure developed by means of said relative rotation of said upstanding wall and said bottom with respect to each other, but insufficient to permit passage to the exterior of said workpieces and finishing chips.

Preferably, in said apparatus, the wall is stationary and said bottom is adapted to rotate about said axis, whereby liquid vehicle is impelled radially outwardly by centrifugal force generated by rotation of said bottom, thereby developing said liquid pressure head, said stationary outer wall is a cylindrical wall, said bottom is dish-shaped (preferably upwardly-concave) or at least has a portion which slopes upwardly toward the outer wall, as shown in FIGS. 1 and 10 hereof. Preferably also, the apposed surfaces are apposed cylindrical surfaces, and preferably said surfaces are parallel or apposed conical surfaces. Preferably also, in such apparatus, said cylindrical outer wall and said bottom have diameters such that the seal elements between them have essentially the same diameter as said cylindrical wall, whereby liquid vehicle which collects in the outer edge areas of said finishing chamber bottom is forced into said seal. Moreover, the cylindrical wall and the upper portion of said cylindrical surfaces advantageously have diameters such that the seal elements between the tops of said conical surfaces, when present, have essentially the same diameter as said cylindrical wall, whereby liquid vehicle which collects in the outer edge areas of said finishing chamber bottom is forced into said seal.

Further advantageously, the cylindrical wall and said cylindrical surfaces have diameters such that the seal elements between said parallel surfaces have essentially the same diameter as said cylindrical wall, whereby liquid vehicle which collects in the outer edge areas of said finishing chamber bottom is forced into said seal.

As for the essential surface irregularity, at least one of the apposed surfaces of said sealing means may merely be roughened to provide the irregularity, but the irregularity preferably comprises channels extending from the finishing chamber to the exterior, the channels being of insufficient size to permit passage of said workpieces and said chips, although it may comprise undulations or serrations. Preferably the channels or other irregularities are located in the inner rotating surface of the sealing means and, when present, said channels are preferably axial, crisscross said inner surface, or are angled downwardly in the direction of the rotation of the bottom of the finishing chamber.

Advantageously, the outer element of the sealing means is arranged so as to comprise a replaceable part of the outer wall, and said wall comprises a lining of elastomer affixed to a rigid outer wall member and said replaceable part of said wall comprises a removable annulus of elastomer adapted to be juxtaposed to the bottom of said lining, said annulus further comprising means for removably affixing it to said rigid wall. Further advantageously, the inner element of the sealing means is arranged so as to comprise a replaceable part of said bottom, and said bottom comprises a lining of elastomer affixed to a rigid outer bottom member and said replaceable part of said bottom comprises a removable annulus of elastomer adapted to be juxtaposed to the outer rim of said rigid outer bottom member and said lining, said annulus further comprising means for removably affixing it to said rigid bottom member.

"Finishing chips", "finishing particles", and "finishing medium", "media", or "materials" are all terms of art having their usual meanings. When the terms "finishing materials" or "finishing media" are used herein, they are intended to define loose, comminuted, granular, or particulate, and in any event, solid finishing materials of the type which are presently employed in the trade and any others of a similar nature. Such materials or media include discrete "particles" called "chips" in the trade. When such "chips" or "particles" are described herein as "relatively large", such reference means relative to the magnitude of the opening of the seal at the juncture of the relatively moving surface portions of the seal. Such description indicates impenetrability of the opening between the sealing surfaces by the intact or nearly intact particles or "chips" comprising the finishing medium.

For purposes of the invention, it is essential that the seal be of resilient material and that the apposed faces of the sealing elements comprise, on at least one of said faces, irregularities of the nature of roughening, channels, or periodic gaps, for purposes of reducing the footprint or area of contact between the seal element surfaces (if they are so spaced as to be in contact), to provide a path for the liquid vehicle from the interior of the finishing chamber to the exterior of the finishing chamber through the seal for purposes of lubricating and cooling the same in addition to the usual functions of the liquid vehicle in the finishing mass itself, and to provide a path for the fines which may become entrained with the liquid vehicle to the exterior of the finishing chamber. The apposed faces of the seal elements can, if desired, be in touching relationship with each other, by means of contact between the irregular, undulating, channeled or like surfaces, with each other, or they may be merely in close proximity with each other, that is, in closely spaced apart relationship. In this regard, the apposed surfaces of the seal elements may, if desired, be out of solid frictional contact with each other, and generally have a space of up to 3/32nds of an inch therebetween at a maximum, preferably no more than 1/16th of an inch, if they are not in contact with each other. Likewise, the irregularities in the surface of one or both of the sealing elements are generally not more than 3/32nds and preferably not more than 1/16th of an inch in both width and depth, thereby to effect the desired objectives of the present invention, namely, to permit exit of liquid vehicle from the interior of the finishing chamber through the liquid seal upon creation of a head or liquid force in the area of the seal, but prevent exit of parts and finishing chips from the area of the finishing operation through the seal. The magnitude of the irregularities, undulations, channels, or the like, mentioned in the foregoing, preferably apply as maximum dimensions whether the apposed surfaces of the sealing elements are spaced apart from each other, to the extent indicated as satisfactory in the foregoing, or whether they are in touching contact at their outermost points or apices. Generally, the two surfaces of the two apposed sealing elements will be in touching contact or have a very slight gap therebetween.

Thus, by the operation of the method and according to the apparatus of the present invention, the seal is located near the edge of the finishing machine bottom where centrifugal force pressure, that is, a head of liquid force, as for example generated by a rotating bottom, is at its greatest, and the liquid vehicle is accordingly forced outwardly to the exterior of the finishing chamber through the seal by this head of liquid force, thereby cooling and lubricating the seal elements themselves, in addition to its usual and normal function of cooling the finishing operation and removing fines from the surface of finishing chips and parts being finished therein.

Advantageously, the juxtaposed surfaces of the cylindrical outer wall and bottom, and of the apposed sealing elements between them, are apposed cylindrical surfaces, which are preferably parallel. Also, it is desirable that the cylindrical outer wall and said bottom and the cylindrical surfaces of the sealing elements between them have diameters such that the seal elements have essentially the same diameter as the cylindrical wall, so that liquid vehicle, with entrained "fines", which collects in the outer edge or rim areas of said finishing chamber bottom, is forced into said seal.

If desired, however, the apposed surfaces of the sealing elements can be apposed conical surfaces. In such case, the conical surfaces can taper inwardly or outwardly toward the bottom, or both inwardly and outwardly (or vice versa), in each case to produce a somewhat different and thus optionally variable effect upon the rate of outflow of liquid vehicle to the exterior under the liquid pressure head built up in the area of the seal due to relative rotation of the upstanding outer wall and bottom, e.g., due to centrifugal force developed by rotation of said bottom.

In every case, one or both of the apposed surfaces of the sealing elements, e.g., the surface of the sealing element which is attached to the rotating bottom, is necessarily irregular. The surface may be roughened, but preferably said surface has channels, extending from the interior of the chamber to the exterior thereof. In any case, the irregularities, whatever the form they may take, are of insufficient size to permit passage of workpieces or the relatively large finishing chips. These irregular surfaces, particularly the channels, are of assistance in imparting a swirling motion or turbulence to the liquid vehicle passing through the sealing means and help to break up agglomerations of "fines" which might become lodged within the sealing element faces. The channels, e.g., can be axially-disposed or they can be criss-crossed and, advantageously, they can be angled downwardly in the direction of rotation of the bottom so as to tend to impart an upward chamber-retaining force vector to liquid vehicle which comes in contact therewith. Such a fluid seal is essentially non-clogging as a result of this inherently self-cleansing design feature.

Advantageously, the finishing chamber is lined with a soft resilient material to protect the parts or workpieces being finished. Ordinarily this is made of urethane elastomer. A coating of this urethane is bonded to the upstanding wall and another coating is bonded to the upper or chamber-forming surface of the bottom. The linings can be shaped to themselves provide mutually apposed surfaces of the sealing means or, advantageously, these linings can have removable and replaceable insets providing the apposed faces required in the sealing means. The removable insets can be provided with means for affixing them, respectively, to the rigid part of the upstanding wall and/or to the upper surface of the outer rigid part of the bottom member, or both.

The apposed faces of the sealing means, advantageously, have a size or thickness which, at the shortest distance from inside the chamber to the exterior, is at least several times the width of the space between the faces. The escaping or exiting fluid vehicle, which is generally water, aqueous detergent solution, or the like, cools and lubricates the sealing surfaces during its travel to the exterior.

BRIEF DESCRIPTION OF THE DRAWINGS

The invention will now be described with particular reference to the drawings, in which:

FIG. 3 is a face view of a modified detail of FIG. 2.

FIG. 4 is a face view of another modified detail of FIG. 2.

FIG. 5 is a face view of still another modified detail of FIG. 2.

FIG. 6 is a top view of any of FIGS. 3, 4, and 5.

FIG. 7 is a modified form of FIG. 2.

FIG. 8 is a modified form of FIG. 7.

FIG. 9 is still another modified form of FIG. 7.

FIG. 10 is a partial section of a modified form of the invention.

DETAILED DESCRIPTION OF THE INVENTION

Figure 1:
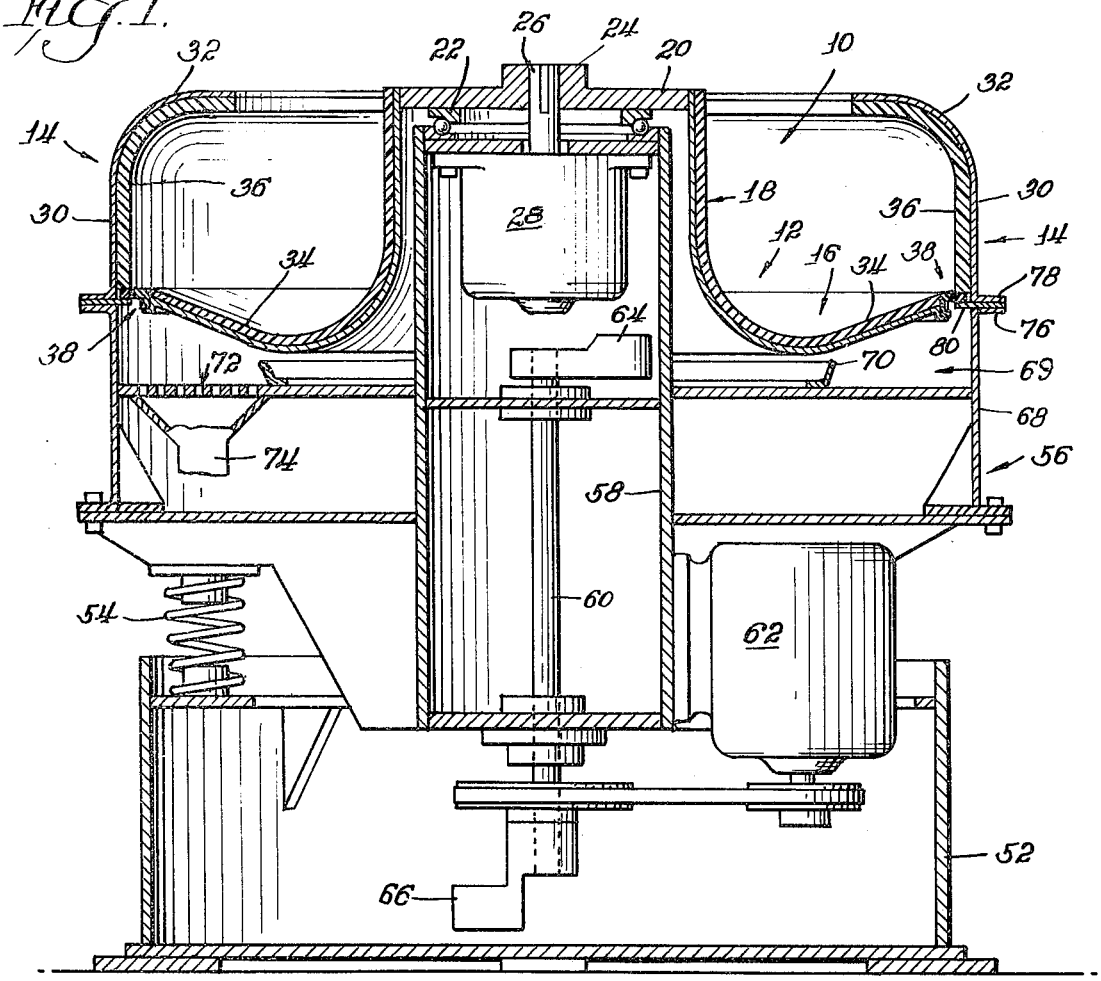
FIG. 1 is a vertical section of one form of the invention.
Figure 2:
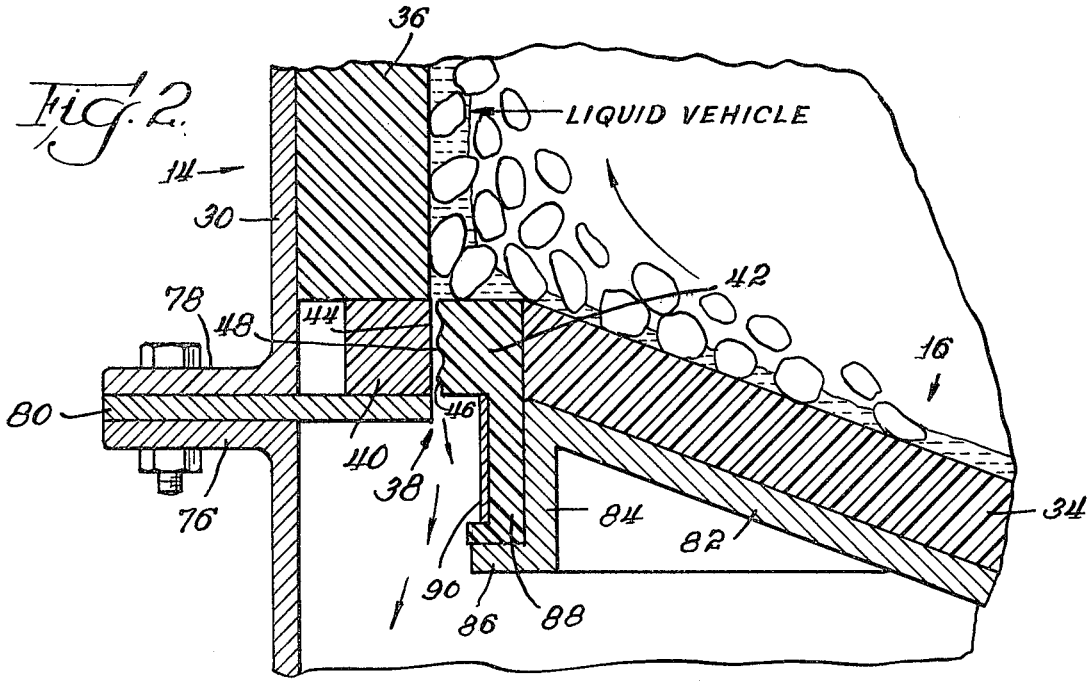
FIG. 2 is an enlarged section of a detail of FIG. 1.

Referring now particularly to FIGS. 1 and 2, there is illustrated a form of the invention which comprises an annular or torodial-shaped finishing chamber 10 having a containing surface comprising a rotatable portion 12 and a stationary portion 14.

The rotatable portion 12 has a dish-shaped bottom 16 and an upstanding rear wall 18 which is affixed to a wheel 20 mounted for rotation in a horizontal plane on bearings 22.

The wheel 20 has a hub 24 keyed to the shaft 26 of the motor 28.

The motor 28 drives the wheel 20, to which the cylindrical wall 18 is attached, and thus imparts rotary motion to rotatable portion 12 of the annular chamber.

The stationary portion 14 comprises an upstanding outer cylindrical wall member 20 which curves in at the top, as shown at 32, leaving an annular opening between the curved-in portion 32 and the upstanding wall 18.

Both the rotatable portion 12 and the stationary portion 14 are lined with urethane or like elastomer, 34 and 36 respectively, to cushion the parts or workpieces which are finished in the annular finishing chamber 10.

Between the closely-spaced apposed surfaces at the periphery of the dish-shaped bottom 16 and the upright cylindrical wall 30 is a seal 38, as best seen in the enlarged detail of FIG. 2. In a preferred form of the invention, this seal comprises two annular members or elements 40 and 42 having apposed parallel faces 44 and 46. These apposed parallel faces are spaced so that the dish-shaped bottom 16 is free to rotate with respect to, and may, if desired, be out of solid frictional contact with, the outer upstanding cylindrical wall 30. As previously stated, the spacing between apposed surfaces, if not in touching contact, should generally not exceed 3/32 of an inch, preferably 1/16 of an inch, and the irregularities in the seal element surfaces should likewise be no greater than the stated dimensions, whether or not the seal surfaces are in touching relationship at the outer extremities or apices of the irregularities on the surface of one or both of the seal elements.

The spacing between the apposed faces or surfaces 44 and 46, and the irregularities thereon, are such, however, that while sufficiently large to permit exit of liquid vehicle from the chamber, under a head of liquid pressure, their size is insufficient to permit passage of workpieces and the relatively large finishing chips. The irregularities and spacing are of a size sufficient to permit outflow of extremely fine finishing particles which are sometimes added along with the relative larger finishing chips and/or the fine detritus resulting from the deburring or polishing of the workpieces in the chamber as well as by attrition of the larger particles of finishing material themselves during the finishing process.

For this purpose, it has been found necessary to provide one or the other, or both, of the apposed sealing element surfaces 44 and 46 with irregularities, for example, by roughening as shown at 48 in FIG. 2, for the reasons already set forth, as well as to help dislodge and disintegrate mass accumulations of "fines" which would otherwise obstruct the flow of liquid vehicle from the chamber to the exterior. If the surface of only one seal member is roughened, or otherwise irregular, the irregular surface may advantageously be the inner annular seal element 42, as shown at 48.

As shown in FIG. 3, it is of advantage to provide the necessary surface-irregularity in the form of serrations, channels, or slots 50 which extend axially across the face of the apposed parallel surface 46. Alternatively, the serrations, slots, or channels can criss-cross across the face of the apposed surface 46, as shown in FIG. 4. Further alternatively, they may angle downwardly across the face of the apposed parallel surface 46 in the direction of the rotation of the bottom 16, as shown in FIG. 5. In this arrangement, the slope of the serrations, slots, or channels 50*a*, when located solely in face 46, tends to impart an upward force vector to the liquid vehicle flowing downwardly under pressure between the apposed parallel surfaces 44 and 46, thereby somewhat retarding the rate of outflow of liquid vehicle from the finishing chamber.

The annular finishing chamber 10 is supported on a base member 52 in a manner similar to that shown in U.S. Pat. No. 3,990,188. On the base member 52, supported by springs 54, is intermediate support base 56. Affixed to this intermediate support base 56 is a vertical, cylindrical column 58, the top of which supports the bearing race 22 and the motor 28 and the bottom portion of which supports the shaft 60 which is driven by motor 62 and which has, at opposite ends, offset weights 64 and 66 which, on rotation of the shaft 60, impart a vibratory motion to the annular finishing chamber 10. This gyratory unit can be actuated either in conjunction with the rotatory unit, or it can be activated only after a finishing cycle, and is usually employed in conjunction with an internal separation unit of known type (not shown).

The intermediate support 56 has an annular pan 69 formed by the outer wall 68 of the intermediate support 56, an annular plate bridging the wall 68 and the cylindrical member 58 and upstanding wall member 70. This annular pan 69 collects the outflowing liquid vehicle and allows it to discharge through the apertures 72 into the conduit 74 which leads it off for storage or for recycling, preferably after filtration or other solids removal procedure.

The cylindrical wall 68 has a flange 76 complementary to a flange 78 at the bottom of the cylindrical wall 30. The flanges 76 and 78 are adapted to be bolted together against an annulus 80.

The annulus extends inwardly sufficiently to form a support for the outer annular seal element 40. The seal element 40 is advantageously affixed to the annulus 80 as a unitary or integral structure, so that the annular seal element 40 can be removed and replaced whenever the need arises.

The annular seal element 40, advantageously and as shown, is cast of urethane and is set on the annulus 80 to abut the urethane lining 36 and to form an apparent extension thereof. It will be understood, however, that the annular seal member 40 can be made of any other resilient material, such as natural or synthetic rubber or other elastomer.

The dish-shaped bottom 16 has a urethane lining 34 affixed to an outer rigid bottom member 82, usually constructed of steel or the like. At the outer periphery thereof, bottom member 82 has a depending flange 84 with a projecting shoulder 86 located at the bottom thereof. The urethane lining 34 extends up to the top of the flange 84 and forms an apparent extension thereof.

The inner annular seal element 42, advantageously and as shown, is constructed of the same urethane elastomer as the lining 34 and 36. The upper portion thereof, which corresponds in thickness to the lining 34, is the portion which has the irregular face 46 which is apposed to the face 44 of the outer annular seal element 40. Integral with the bottom of the annular seal element 42 is a downwardly projecting annulus 88 adapted to fit snugly to the flange 84 and shoulder 86 and to be held tightly thereagainst by the clamp 90.

In the operation of the device of FIGS. 1, 2, 3, 4, 5, and 6, the parts or workpieces, the relatively large finishing chips, and the liquid vehicle, along with any fine finishing material which it may be desired to add, are charged into the annular finishing chamber 10 through the open top thereof. Rotation of the rotating portion 12 causes the contents of chamber 10 to be impelled radially outwardly, by centrifugal force generated by said rotation. Liquid medium therein sweeps up across the upward slope of the dish-shaped bottom 16 and impinges on the lining 36 of the outer upstanding wall 30. As rotation continues, a fluid pressure head builds up alongside the upstanding wall, at its juncture with bottom 16 and in the area of the seal, i.e., in the outer edge or rim areas of the finishing chamber bottom, and is forced by said fluid pressure head into said seal. The fluid pressure head is clearly visible in this area and marked "LIQUID VEHICLE" in FIG. 2. Thus, relative motion is imparted to the contents of the chamber, including the liquid vehicle, to cause finishing of the parts, and said contents are caused to flow outwardly across a containing surface, a portion of which moves relative to another portion thereof, in such a manner that the liquid vehicle, including any "fines" entrained therein, is forced to flow to the exterior between these relatively closely-positioned relatively rotating portions, whereas passage or exit to the exterior of workpieces and relatively large finishing chips is prevented.

Liquid vehicle, as is conventional in the finishing art, is introduced into the finishing operation through the open top of the finishing chamber. The liquid vehicle serves to cool the reaction mass, and to carry off or entrain "fines", thereby removing them from the area of the major finishing operation, and the liquid may be or comprise water, aqueous detergent or soap solution, solutions of chemical cleansing or brightening agents, or the like, all as conventional in the art. Such liquid vehicle may as usual be introduced at a metered flow-rate through ancillary equipment such as storage container, pump, and associated pipes, hoses, or tubing, none of which is shown or of the essence of the present invention. The liquid vehicle may simply be dumped into the open top of the finishing material from a bucket or other container, if this is satisfactory for the particular finishing operation involved. Ordinarily the source of the liquid vehicle for intermittent or continuous introduction into the finishing operation and chamber is through spray headers or perforated pipe or tubing or the like, located either internally of the finishing chamber or externally thereof, and most conveniently through such pipe or tubing peripherally located at or near the upper edge of an upstanding wall of the finishing chamber, preferably at or about the inner lip of the outer upstanding wall of the finishing chamber. All of this equipment and ancillary equipment for introduction of the liquid vehicle intermittently or continuously into the finishing operation and finishing chamber is standard and conventional in the art as it exists today and is accordingly not shown in the drawings.

In FIGS. 7, 8, and 9, there are shown modifications of the apparatus of FIGS. 1 and 2 in which the apposed faces 44 and 46 of seal elements 40 and 42, instead of being cylindrical as shown in FIGS. 1 and 2, have different configurations. Either or both surfaces may be irregular. Thus, in FIGS. 7 and 8, the apposed parallel faces are conical. In FIG. 7, the apposed parallel faces **44*a* and 46*a* slope downwardly and inwardly, with the result that, when the inner surface 46*a* is irregular, as in FIGS. 2, 3, 4, and 5**, an upward force vector is imparted, so that outflow of liquid vehicle is somewhat decelerated.

In the modification of FIG. 8, the apposed surfaces **44*b* and 46*b*** slope downwardly and outwardly.

In FIG. 9, the surfaces **44*c* and 46*c*, either or both of which are irregular, slope both outwardly and inwardly, so that a decelerative dam of turbulence is established at the bite or center 92**, which also has the effect of reducing outflow of liquid vehicle from the finishing chamber.

In the known modification shown in FIG. 10, the dish-shaped bottom **16*a*, comprising outer member 82*a* and lining 34*a*, extends the entire interior radius of the apparatus and is affixed to central shaft 94, which is adapted to rotate about center line 96. The outer periphery of this dish-shaped bottom 16*a* is provided with a seal 38 having elements 40 and 42 constructed as described in the foregoing, and located at the point where its outer edge or rim surface lies in closely spaced relationship to the surface of outer upstanding cylindrical wall 30** near the bottom thereof.

In all of FIGS. 7, 8, 9, and 10, the details of the surfaces 44 and 46 (or **44*a*, 46*a*; 44*b*, 46*b*; 44*c*, 46*c*) of seal elements 40 and 42 are as shown in expanded detail, especially as to the necessary surface irregularities on at least one of the apposed seal element surfaces, in FIGS. 2 through 6**.

As described in U.S. Pat. No. 3,435,565, when only means for rapid rotation of the medium and parts about a substantially vertical axis are employed, the mass or content of the finishing chamber assumes an outward and upward plus inward and downward motion, thereby producing a toroidal flow with individual parts and particles of the medium travelling helically around the toroid. When means, now well-known in the art, for imparting vibratory or gyratory motion to the contents of a curvilinear or arcuate-bottom finishing chamber (as here involved; see FIGS. 1 and 10) are also present, the parts or workpieces and/or finishing material contained therein undergo the further or accelerated motion which may be described as toroidal precession, i.e., the contents move upwardly at the peripheral portion of the chamber and downwardly at the inner portion of the chamber, while simultaneously describing precessional motion (linear progression) around the chamber in the direction of rotation of the bottom. Such motion results in further relative movement between the finishing material and the workpieces, or at least further interaction therebetween, causing the parts to be further and more efficiently finished, and morover can be used to assist in separation of finished parts by co-operation of such precessional motion with internal separating means, especially since the rate of precession can be readily controlled by control of the gyratory motion imparted to the finishing chamber, all as well known in the art and as fully described and claimed in U.S. Pat. Nos. 3,990,188 and 4,026,075.

It is to be understood that the invention is not to be limited to the exact details of operation or structure shown and described, as obvious modifications and equivalents will be apparent to one skilled in the art.

I claim:

1. Apparatus for finishing parts or workpieces by attrition with loose, comminuted, granular, or particulate solid finishing material comprising relatively large finishing chips in the presence of a liquid vehicle, which includes:

a finishing chamber having a containing surface comprising an outer upstanding wall and a bottom, said upstanding wall and said bottom being symmetrically arranged about a common axis and being relatively rotatable about said axis in order to impart motion to the contents of said chamber for finishing of said parts, and means for causing such relative motion, characterized in that said wall and said bottom have closely-spaced apposed surfaces and a resilient seal having corresponding apposed elements therebetween, the apposed elements of said seal being in closely-spaced or touching relationship and the surface of at least one of said apposed seal elements being irregular, thereby providing communication between said chamber and the exterior, said irregular surface being adapted to impart a swirling or turbulent motion to the liquid vehicle passing through the seal by means of said surface irregularities, thereby retarding the rate of outflow of liquid vehicle from the finishing chamber so as to enable better cooling and cleansing of the finishing reaction mass during retention of the liquid vehicle within said finishing chamber, and better cooling and lubrication of the said sealing surfaces during travel of the liquid vehicle to the exterior upon being subjected to a sufficient liquid pressure head; and said spacing and irregularities being of a size sufficient to permit flow from the interior to the exterior of said finishing chamber of liquid vehicle therein, including "fines" which may be entrained therein, when placed under a head of liquid pressure developed by means of said relative rotation of said upstanding wall and said bottom with respect to each other, but insufficient to permit passage to the exterior of said workpieces and finishing chips.

2. Apparatus of claim 1 in which said wall is stationary and said bottom is adapted to rotate about said axis, whereby liquid vehicle is impelled radially outwardly by centrifugal force generated by rotation of said bottom, thereby developing said liquid pressure head.

3. Apparatus of claim 2, in which said stationary outer wall is a cylindrical wall.

4. Apparatus of claim 3, in which said bottom is dish-shaped or has a portion which slopes upwardly toward said outer wall.

5. Apparatus of claim 3, in which said surfaces are apposed cylindrical surfaces.

6. Apparatus of claim 5, wherein said cylindrical outer wall and said bottom have diameters such that the seal elements between them have essentially the same diameter as said cylindrical wall, whereby liquid vehicle which collects in the outer edge areas of said finishing chamber bottom is forced into said seal.

7. Apparatus of claim 2, in which said surfaces are parallel.

8. Apparatus of claim 2, in which said surfaces are apposed conical surfaces.

9. Apparatus of claim 8, wherein said cylindrical wall and the upper portion of said cylindrical surfaces have diameters such that the seal elements between the tops of said conical surfaces have essentially the same diameter as said cylindrical wall, whereby liquid vehicle which collects in the outer edge areas of said finishing chamber bottom is forced into said seal.

10. Apparatus of claim 7, wherein said cylindrical wall and said cylindrical surfaces have diameters such that the seal elements between said parallel surfaces have essentially the same diameter as said cylindrical wall, whereby liquid vehicle which collects in the outer edge areas of said finishing chamber bottom is forced into said seal.

11. Apparatus of claim 8, wherein said conical surfaces taper downwardly and inwardly, whereby flow to the exterior of liquid which is decelerated; or both outwardly and inwardly, thereby creating a decelerative dam of turbulence.

12. Apparatus of claim 2, wherein at least one of the apposed surfaces of said sealing means is roughened to provide said irregularity.

13. Apparatus of claim 2, in which said irregularity comprises channels extending from said chamber to the exterior, said channels being of insufficient size to permit passage of said workpieces and said chips.

14. Apparatus of claim 13, in which said channels are in the inner rotating surface of said sealing means.

15. Apparatus of claim 14, in which said channels are axial.

16. Apparatus of claim 14, in which said channels criss-cross said inner surface.

17. Apparatus of claim 14, in which said channels angle downwardly in the direction of the rotation of said bottom.

18. Apparatus of claim 2, in which the outer element of said sealing means is so arranged as to comprise a replaceable part of said wall.

19. Apparatus of claim 18, in which said wall comprises a lining of elastomer affixed to a rigid outer wall member and said replaceable part of said wall comprises a removable annulus of elastomer adapted to be juxtaposed to the bottom of said lining, said annulus further comprising means for removably affixing it to said rigid wall.

20. Apparatus of claim 2, in which the inner element of said sealing means is so arranged as to comprise a replaceable part of said bottom.

21. Apparatus of claim 20, in which said bottom comprises a lining of elastomer affixed to a rigid outer bottom member and said replaceable part of said bottom comprises a removable annulus of elastomer adapted to be juxtaposed to the outer rim of said rigid outer bottom member and said lining, said annulus further comprising means for removably affixing it to said rigid bottom member.

22. An improved method for finishing parts or workpieces by a process which comprises subjecting said parts or workpieces to attrition by relative motion with loose, comminuted, granular, or particulate solid finishing material comprising relatively large finishing chips in the presence of a liquid vehicle in a finishing chamber, having a containing surface comprising an outer upstanding wall portion and a bottom portion, with a seal between, characterized by providing said seal with resilient apposed surfaces, having irregularities on at least one surface and spacing of a size sufficient to permit passage therethrough of liquid vehicle under pressure, causing relative motion between said portions of said containing surface and between said workpieces and said finishing chips, causing said vehicle, said workpieces, and said finishing chips to flow over said containing surface and across said seal to cause finishing of said workpieces and to develop a resulting liquid pressure head in the area of said seal, and imparting a swirling or turbulent motion to the liquid vehicle passing through the seal by means of said surface irregularities, thereby retarding the rate of outflow of liquid vehicle from the finishing chamber so as to enable better cooling and cleansing of the finishing reaction mass during retention of the liquid vehicle within said finishing chamber, and better cooling and lubrication of the said sealing surfaces during travel of the liquid vehicle to the exterior upon being subjected to a sufficient liquid pressure head; and causing flow of said liquid vehicle to the exterior of said containing surface through said seal under the influence of said liquid pressure head, while preventing flow to the exterior of said workpieces and said finishing chips through said seal, thereby simultaneously lubricating and cooling said seal and removing fines entrained in said liquid from said finishing chamber.

23. The method of claim 22, wherein said bottom is rotatable and which includes the step of rotating said bottom about said axis, whereby liquid vehicle is impelled radially outwardly by centrifugal force generated by rotation of said bottom, thereby developing said liquid pressure head.

24. The method of claim 23, wherein said liquid vehicle is caused to flow radially outwardly and to impinge upon said wall.

25. The method of claim 24, in which the flow to the exterior of said liquid vehicle is effected adjacent a point at which outwardly-flowing liquid vehicle impinges upon said wall.

26. The method of claim 25, in which the flow of liquid vehicle to the exterior is directed downwardly.

* * * * *

UNITED STATES PATENT AND TRADEMARK OFFICE

CERTIFICATE OF CORRECTION

PATENT NO. : 4,177,608

DATED : December 11, 1979

INVENTOR(S) : Gunther W. Balz

It is certified that error appears in the above—identified patent and that said Letters Patent is hereby corrected as shown below:

Col. 2, line 12; "realtive" should read -- relative --
Col. 2, line 16; "portion and and a" should read -- portion and a --
Col. 10, line 17; "morover" should read -- moreover --
Col. 11, line 42; "liquid which is" should read -- liquid vehicle is --

Signed and Sealed this

*Twenty-fourth* Day of *June 1980*

[SEAL]

*Attest:*

SIDNEY A. DIAMOND

*Attesting Officer*

*Commissioner of Patents and Trademarks*